US012398491B2

(12) United States Patent
Gehring et al.

(10) Patent No.: US 12,398,491 B2
(45) Date of Patent: Aug. 26, 2025

(54) DEVICE AND METHOD FOR ENABLING DISPLAYING ON A USER DISPLAY AN OPERATIONAL READINESS INDEX RELATED TO A SPINNING MILL

(71) Applicant: Maschinenfabrik Rieter AG, Winterthur (CH)

(72) Inventors: David Gehring, Henggart (CH); Maurizio Troglio, Henggart (CH); Marcel Rengel, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 64 days.

(21) Appl. No.: 18/570,333

(22) PCT Filed: Jun. 13, 2022

(86) PCT No.: PCT/IB2022/055445
§ 371 (c)(1),
(2) Date: Dec. 14, 2023

(87) PCT Pub. No.: WO2022/263995
PCT Pub. Date: Dec. 22, 2022

(65) Prior Publication Data

US 2024/0271337 A1 Aug. 15, 2024

(30) Foreign Application Priority Data

Jun. 16, 2021 (EP) ..... 21179730

(51) Int. Cl.
*D01H 13/32* (2006.01)

(52) U.S. Cl.
CPC ..... *D01H 13/32* (2013.01)

(58) Field of Classification Search
CPC ..... D01H 13/32
USPC ..... 340/680
See application file for complete search history.

(56) References Cited

U.S. PATENT DOCUMENTS 5,083,298 A * 1/1992 Citterio ..... B65H 54/26 367/13
5,515,266 A * 5/1996 Meyer ..... D01H 13/32 57/264
5,517,404 A * 5/1996 Biber ..... D01H 13/32 700/130
11,111,102 B2 * 9/2021 Schmolke ..... B65H 75/182
(Continued)

FOREIGN PATENT DOCUMENTS

KR 102 183 328 B1 11/2020
WO WO 2019/048150 A1 3/2019

OTHER PUBLICATIONS

PCT Search Report, Aug. 26, 2022.
Brochure—SPIDERweb Spinning Mill Control System, Dec. 1, 2016—https://www.rieter.com/fileadmin/user_upload/products/documents/digitalization/spiderweb/rieter-spiderweb-brochure-2862-v2-en.pdf.

*Primary Examiner* — Kerri L McNally
(74) *Attorney, Agent, or Firm* — Dority & Manning, P.A.

(57) ABSTRACT

An electronic device (eD) configurable with a textile machine, and associated method of operation, includes a user display that displays an operational readiness index (ORI) related to the spinning mill. The electronic device (eD) is configured to: collect operating information of the spinning mill; from the operating information, determine the operational readiness index (ORI); access the operational readiness index; and display the operational readiness index (ORI) on the user display.

24 Claims, 4 Drawing Sheets

(56) References Cited

U.S. PATENT DOCUMENTS

| | | | | |
|---|---|---|---|---|
| 2016/0299490 | A1* | 10/2016 | Gruber | G05B 19/4155 |
| 2017/0146989 | A1* | 5/2017 | Locatelli | G05B 23/0283 |
| 2021/0148012 | A1* | 5/2021 | Archontopoulos | D01H 1/02 |
| 2021/0342705 | A1* | 11/2021 | von Grünigen | D01H 13/14 |

* cited by examiner

DEVICE AND METHOD FOR ENABLING DISPLAYING ON A USER DISPLAY AN OPERATIONAL READINESS INDEX RELATED TO A SPINNING MILL

FIELD OF INVENTION

The disclosure relates to a device and a method for enabling displaying on a user display an operational readiness index related to a spinning mill.

DESCRIPTION OF RELATED ART

A spinning mill typically includes a large number of textile machines and auxiliary machines for converting natural and man-made fibers and their blends into yarns of a desired quantity and quality. Several types of textile machines may be arranged along a production line, such as textile machines for fiber preparation, textile machines for spinning preparation, ring spinning machines, compact spinning machines, rotor spinning machines, air-jet spinning machines, automation machines, winding machines, texturing machines, etc. The work of the textile machines is supported by a variety of auxiliary machines, which can be directly involved in the progressing production process (such as conveyors between individual textile machines) or indirectly (such as air conditioning systems or laboratory instruments).

A spinning mill may include several hundred textile machines of different types as well as auxiliary machines and may cover an area of several hundred square meters. Furthermore, textile machines and auxiliary machines may include several hundred or several thousand components, in particular components for processing textile materials running in a parallel manner. During the process of converting natural and man-made fibers and their blends into yarns, textile materials may be opened and cleaned, converted into card sliver, processed by draw frames and/or roving frames, spun into yarns, automatically transported from a previous textile machine to a next textile machine, rewound to assure a proper yarn performance in further manufacturing processes, textured to provide fiber-look to flat filament yarns, etc. In order to provide a desired production capacity along a serial production line, textile machines or components of textile machines may include parallel configurations.

Thus, a previous processing step may be serially followed by a next processing step, wherein the previous processing step may require less or more parallel textile machines or components for processing textile materials than the next processing step. For example, the step of fiber preparation delivering slivers may require fewer parallel machines or components than the step of spinning slivers into yarns. Moreover, for the purpose of flexibility, redundancy, machine maintenance, etc., additional machines may be arranged, which may provide alternative or additional production capacity during particular time periods. Furthermore, for example depending on a production plan requiring less textile machines during the night than during the day, particular textile machines may be brought to a stop during particular time periods. For example, during a later time period, production may involve another set of textile machines than during an earlier time period.

For operating a spinning mill, for example at a control room of the spinning mill, user displays and user interfaces are installed for monitoring operation of the spinning mill and for controlling operation of the spinning mill by operator persons. For example, a user display may display rotation speed or productivity of the various textile machines, or quantity and quality of the fibers and/or intermediate products which are processed by the various textile machines.

BRIEF SUMMARY OF THE INVENTION

Additional objects and advantages of the invention will be set forth in part in the following description, or may be obvious from the description, or may be learned through practice of the invention.

Operational readiness of the spinning mill is often not clear to the operator persons, and operator persons often do not know if the spinning mill has a normal operational readiness or a below than normal operational readiness. This in particularly also applies to supervisors like production managers, general managers, and spinning mill owners. Within the context of the present application, operational readiness generally describes the ability of a spinning mill and/or the capability of a spinning mill to reliably and efficiently perform its current task as well as to perform already planned as well as possible and probable future tasks. Without knowledge of the operational readiness, an operator person or any person concerned with ensuring an at least satisfactory mill operation performance may not be able to decide if measures have to be taken, if a possibly time-consuming analysis has to be performed, etc., or if the spinning mill is ready for executing already planned as well as possible and probable future tasks.

The present invention is also based on the insight gained by the inventors that an optimized and stable operation of a spinning mill is not possible by optimizing individual units (e.g. individual textile machines) alone, but that the entire system of the spinning mill must be considered— if necessary also including its environment. And at the same time that a real optimization of individual units is often not possible without taking into account their environment (respectively the whole mill). Particularly in the case of modern spinning mills which, as described here, comprise highly complex systems with a large number of interconnected complex subsystems, it is practically impossible for a human decision-maker to objectively assess the operational readiness of such a system in such a way that it is possible to react to existing or impending problems at an early stage by means of adequate technical measures. Part of the present invention was to identify these problems and to provide a technical solution for them.

It is of utmost importance to run a spinning mill as close as possible at its operational readiness (but not above), or maximize overall operations effectiveness (OOE), in particular in order to minimize production loss.

There may be a need for a device and a method for enabling displaying on a user display an operational readiness index related to a spinning mill. In particular, there may be a need for a device and a method for enabling displaying on a user display an operational readiness index related to a spinning mill which overcome at least some of the disadvantages of the prior art. In particular, there may be a need for a device and a method enabling displaying on a user display an operational readiness index (mill operational readiness index) related to a spinning mill for improving operation of the spinning mill. In particular, there may be a need for a device and a method enabling displaying on a user display an operational readiness index related to a spinning mill for informing operator persons (and other persons interested in the operation performance of the spinning mill) if the spinning mill is ready for executing already planned as well as possible and probable future tasks. Hence e.g. also persons responsible for quality assurance and compliance can thus clearly and directly (i.e. without much own investigation, calculation and evaluation) and therefore promptly determine whether mill standards are met or if an intervention in the spinning mill operation is necessary.

Such a need may be met by the subject-matter of the invention disclosed herein. The present invention provides a highly advantageous way to measure how well a spinning mill is operating taking into consideration the therefore required direct and indirect factors and hence allows to stabilize and improve plant behavior. Thus, it becomes possible to provide a composite of likelihood and impact for a given forecasting horizon to execute scheduled production plans.

An aspect of the invention relates to an electronic device for enabling displaying on a user display an operational readiness index related to a spinning mill. The electronic device is configured to perform the steps of: collecting operating information of the spinning mill; determining from the operating information the operational readiness index; accessing the operational readiness index for enabling displaying on the user display the operational readiness index. Operating information may be information related to current operation but may also be information related to planned operation or preventive and predictive information. Operating information and/or the operational readiness index may relate to a subsection of the spinning mill.

Spinning mills in general have an extraordinarily high number of different textile machines, some of which in turn have a large number of individual processing units, some of which are complex, and some of which are linked to each other. On the basis of the operational readiness index, operator persons can decide more quickly if a spinning mill is running in a normal state and is ready for executing already planned as well as possible and probable future tasks. As well operator persons and other persons interested in the performance of the mill (in particular also persons responsible for quality assurance and compliance) can quickly access technical information about the state of the spinning mill and for example quickly decide if the spinning mill is ready for executing a planned production plan, or if the production plan should be transferred to another spinning mill.

Operational readiness can take external aspects into account. For example, the capacity of an electrical power grid available to a spinning mill and/or current failure probabilities of such a grid.

Since the individual textile machines—for example, depending on the end product to be manufactured—can be operated in very different configurations and with a variety of parameters, the actual overall condition of a spinning mill can often not be perceived by an operator person, or only to a limited extent. As a result, a critically low resilience of a spinning mill, for example, can go unnoticed, which means that even a small technical problem can lead to a major problem. Or, due to prolonged production of a particular product, it may go unnoticed that a spinning mill lacks the capacity to produce other products that are in demand for being produced. This may occur because certain machines are defective, have insufficient production capacity, are in need of major maintenance, etc.

Determining the operational readiness index may depend on a configuration of a spinning mill, such as depend on numbers and/or on types of textile machines, depend on numbers and/or types of auxiliary machines, depend on sequences of textile machines, etc. For example, for a first configuration of a spinning mill which includes four draw frame textile machines which are followed by eight speed frame textile machines, the operational readiness index may be determined in a different manner than for a second configuration of a spinning mill which includes only two draw frame textile machines which are followed by eight speed frame textile machines, because failure of a draw frame machine of the first configuration has a different impact on the operational readiness of the spinning mill than failure of a draw frame machine of the second configuration. For example, in case of the first configuration, the operational readiness index can be determined by summing up operating information indicating a quantity of produced textile material of the four draw frame machines and of operating information indicating a quantity of produced textile material of the eight speed frame. For example, the operational readiness index can be determined as a percentage. For example, the operational readiness index can be determined as a percentage relative to nominal values of produced textile materials. For example, the operational readiness index can be determined in accordance with any suitable formula for describing the ability of a spinning mill and/or the capability of a spinning mill to reliably and efficiently perform its current task, as well as possible and probable future tasks. For example, the formula for determining the operational readiness index can include expert knowledge of operator persons of a spinning mill, which expert knowledge may only available to operator persons operating a particular spinning mill. For example, operator persons may have had the experience that operating information of a textile machine of a particular type has more severely affected operational readiness of a spinning mill than a textile machine of another type. Typically, the operational readiness index of a first spinning mill may be determined in a different manner than the operational readiness index of a second spinning mill. Thus, typically, a single formula for determining the operational readiness index of a spinning mill does not exist.

In some embodiments, the electronic device is further configured for collecting operating information which includes machine information of one or more textile machines of the spinning mill. Machine information may include production, quality and energy information (such as rotation speed and energy consumption), variability thereof, time since starting operation, time since last service, number of operational failures, pending tasks etc. Determining the operational readiness index may include aggregating machine information of one or more textile machines.

In some embodiments, the electronic device is further configured for collecting operating information which includes machine information of one or more auxiliary machines of the spinning mill. Within the context of the present invention an auxiliary machine may e.g. be at least a part of a conveyor system (e.g. part of a duct system, or of a trolley-type conveyor system, or of a rail-type transport system). An auxiliary machine may also be at least part of a compressed air system, or of a climate control system (e.g. an air conditioning system for humidity and/or temperature control), or of a cooling system for machines or facility parts, or of a system for power supply etc. Particularly good results may also be obtained if operating information includes machine information which relates to a testing device in a laboratory, such as its operating status for providing accurate test results. This is because, in exceptional cases, a defect or malfunction of a laboratory device that is essential for quality assurance can lead to a standstill of an entire production process. Determining the operational readiness index may include aggregating machine information of one or more auxiliary machines.

In some embodiments, the electronic device is further configured for collecting operating information which includes one or more of a quantity and a quality of one or more of an input textile material and an output textile material of one or more textile machines of the spinning mill. For example, if quantity capacities of individual textile machines are not correctly adapted to each other, for example because of maintenance of particular textile machines, operational readiness of the spinning mill may be degraded. Quantity may relate to production in kg/h (kilogram per hour), delivery m/min (meters per minute), number of can changes at textile machines, etc. For example, if qualities of for example raw cotton is not correctly adapted to the spinning mill, operational readiness may be degraded, also in case qualities of intermediate products are not correctly adapted to the spinning mill. Quality may relate to fiber length, fiber length uniformity, fiber strength, fiber maturity, yarn strength, etc. Such operating information including one or more of a quantity and a quality can be online (e.g. sensors in the production plant) but also offline (laboratory measurements) measured values.

In some embodiments, the electronic device is further configured for collecting operating information which includes one or more environmental information of the spinning mill. Environmental information may relate to atmospheric temperature, atmospheric humidity, atmospheric pressure, air pollution, precipitation, solar irradiation, etc. Environmental information may be based on historic information, current information and/or forecast information.

In some embodiments, the electronic device is further configured for collecting operating information via one or more of a computer network and a user interface. Operating information collected via a computer network may relate to information based on sensors attached to textile machines. Operating information collected via a user interface may relate to information based on laboratory analysis results. An extract, transform, load (ETL) procedure may be involved. Hence, an offline and/or an online user interface may be used.

In some embodiments, the electronic device is further configured for determining the operational readiness index in the form of a single scalar value. A scalar value may be helpful for operator persons for determining operational readiness of the spinning mill quickly. For spinning mills with certain configurations and/or for the production of certain products a single scalar value may also be advantageous to quickly determine the operational readiness of a certain part of the spinning mill or even just of a single machine.

In some embodiments, the electronic device is further configured for determining the operational readiness index in the form of a vector of values. A vector of values may be helpful for indicating operational readiness of subsets of textile machines of the spinning mill.

In some embodiments, the electronic device is further configured for determining the operational readiness index as a percentage. The percentage may be determined with respect to a nominal operational readiness of the spinning mill.

In some embodiments, the electronic device is further configured for transmitting the operational readiness index via one or more of a push interface and a pull interface. A push interface may transmit the operational readiness index to a smartphone of an operator person, and may include an alarm function, in case the operational readiness index is below a predetermined level. A pull interface may enable lookup of the operational readiness of the spinning mill from a smartphone of an operator person with the ability for further drill down.

In some embodiments, the electronic device is further configured for determining information relating to the configuration of the mill for improving the operational readiness index and for enabling displaying this information on the user display.

Information for improving the operational readiness index may include lubrication, replacement of ring travelers of a ring spinning machine, renewal of clothing on a carding machine, purchase of additional or replacement machines, etc.

In some embodiments, the electronic device is further configured for determining actions for improving the operational readiness index and for enabling displaying these actions on the user display. Actions may include reconfiguring textile machines, adapting speed parameters, etc.

Beside an electronic device, the invention also relates to a method for enabling displaying on a user display an operational readiness index related to a spinning mill. The method includes the steps executed by an electronic device of: collecting operating information of the spinning mill; determining from the operating information the operational readiness index; accessing the operational readiness index for enabling displaying on a user display the operational readiness index.

In some embodiments, the method further includes the step of: collecting operating information which includes machine information of one or more textile machines of the spinning mill.

In some embodiments, the method further includes the step of: collecting operating information which includes machine information of one or more auxiliary machines of the spinning mill.

In some embodiments, the method further includes the step of: collecting operating information which includes one or more of a quantity and a quality of one or more of an input textile material and an output textile material of one or more textile machines of the spinning mill.

In some embodiments, the method further includes the step of: collecting operating information which includes one or more environmental information of the spinning mill. Such an embodiment allows currently existing and/or predicted and/or (e.g. statistically) expected environmental influences to be taken into account.

In some embodiments, the method further includes the step of: collecting operating information via one or more of a computer network (respectively data network) and a user interface. An offline and/or an online user interface may be used.

In some embodiments, the method further includes the step of: determining the operational readiness index in the form of a single scalar value.

In some embodiments, the method further includes the step of: determining the operational readiness index in the form of a vector of values.

In some embodiments, the method further includes the step of: determining the operational readiness index as a percentage.

In some embodiments, the method further includes the step of: transmitting the operational readiness index via one or more of a push interface and a pull interface.

In some embodiments, the method further includes the step of: determining information relating to the configuration of the mill for improving the operational readiness index and for enabling displaying this information on the user display.

In some embodiments, the method further includes the step of: determining actions for improving the operational readiness index and for enabling displaying these actions on the user display.

BRIEF DESCRIPTION OF DRAWINGS

The invention will be better understood with the aid of the description of an embodiment given by way of example an illustrated by the figures, in which.

DETAILED DESCRIPTION OF THE INVENTION

Figure 1:
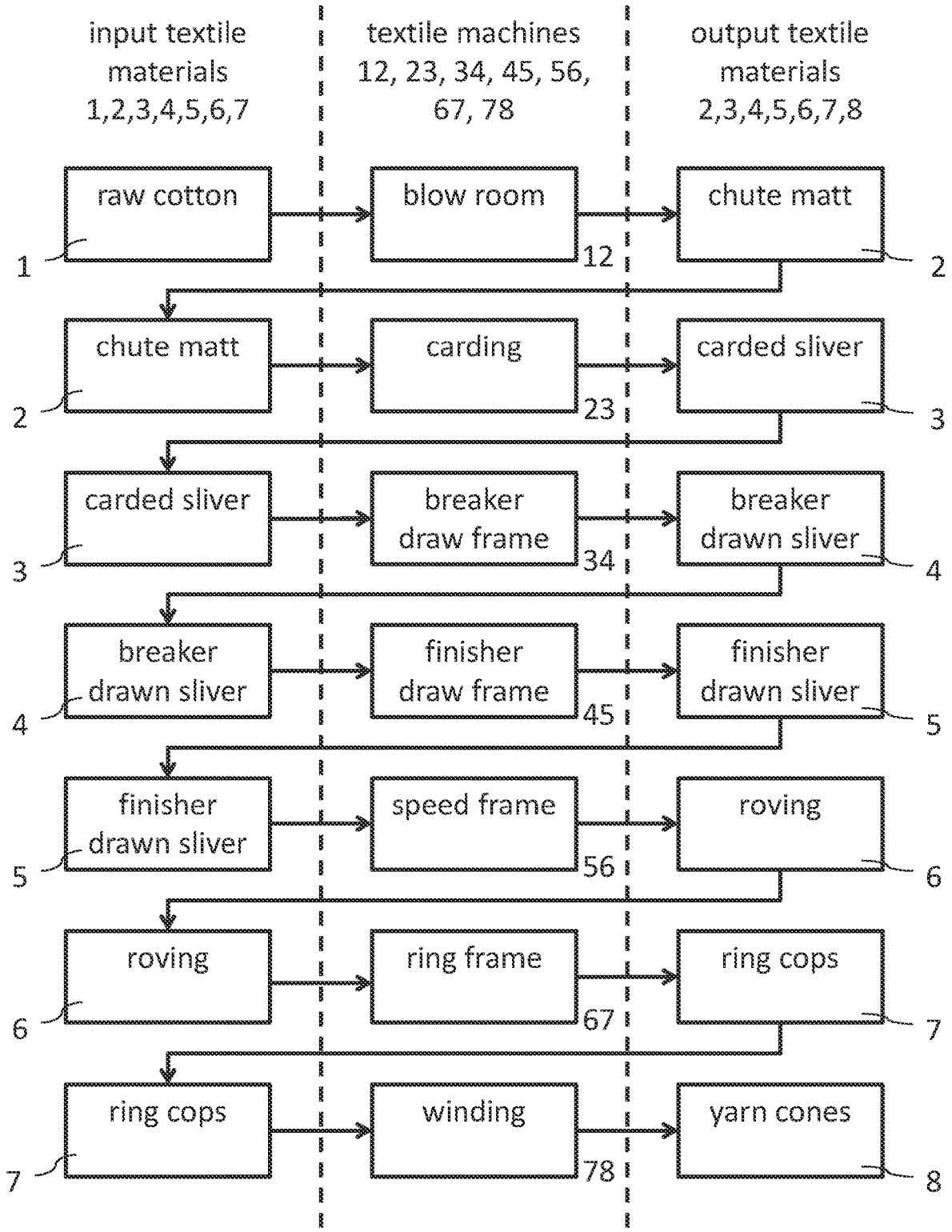
FIG. 1 illustrates schematically exemplary textile machines of a spinning mill for processing input textile materials into output textile materials.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 illustrates schematically exemplary textile machines 12, 23, 34, 45, 56, 67, 78 of a spinning mill for processing input textile materials 1, 2, 3, 4, 5, 6, 7 into output textile materials 2, 3, 4, 5, 6, 7, 8. The spinning mill includes particular numbers of textile machines 12, 23, 34, 45, 56, 67, 78, particular types of textile machines 12, 23, 34, 45, 56, 67, 78 and/or particular sequences of textile machines 12, 23, 34, 45, 56, 67, 78. In the example illustrated in FIG. 1, one or more blow room textile machines 12 are arranged for processing raw cotton 1 into chute matt 2. One or more carding textile machines 23 are arranged for processing chute matt 2 into carded sliver 3. One or more breaker draw frame textile machines 34 are arranged for processing carded sliver 3 into break drawn sliver 4. One or more finisher draw frame textile machines 45 are arranged for processing break drawn sliver 4 into finisher draw sliver 5. One or more speed frame textile machines 56 are arranged for processing finisher draw sliver 5 into roving 6. One or more ring frame textile machines 67 are arranged for processing roving 6 into ring cops 7. One or more winding textile machines 78 are arranged for processing ring cops 7 into yarn cones 8.

A spinning mill enables producing from a source textile material 1 a desired textile material 8 in a desired quantity and/or quality. Each of the textile machines 12, 23, 34, 45, 56, 67, 78 illustrated in FIG. 1 is configured for processing in accordance to a desired quantity and/or quality input textile materials 1, 2, 3, 4, 5, 6, 7 into output textile materials 2, 3, 4, 5, 6, 7, 8. Quantity and/or quality of output textile materials 2, 3, 4, 5, 6, 7, 8 depend on parameters of the textile machines 12, 23, 34, 45, 56, 67, 78 and/or on parameters of the input textile materials 1, 2, 3, 4, 5, 6, 7. Quantity and/or quality of output textile materials 2, 3, 4, 5, 6, 7, 8 may not only depend on parameters of the direct input textile material 1, 2, 3, 4, 5, 6, 7 of a particular textile machines 12, 23, 34, 45, 56, 67, 78, but may also depend on parameters of any earlier textile material 2, 3, 4, 5, 6 produced by any earlier textile machine 12, 23, 34, 45, 56, as well as on parameters of the source textile material 1. For example, the direct input textile material 4 of the finisher draw frame 45 is break drawn sliver 4, while the earlier textile materials also include the raw cotton 1, the chute matt 2, and the carded sliver 3. Thus, quantity and/or quality of an output textile material 2, 3, 4, 5, 6, 7, 8 may not only be degraded if quantity and/or quality of the direct input textile material 1, 2, 3, 4, 5, 6, 7 does not match a desired quantity and/or quality, but quantity and/or quality of an output textile material 2, 3, 4, 5, 6, 7, 8 may also be degraded if quantity and/or quality of an earlier input textile material 1, 2, 3, 4, 5, 6 does not match a desired quantity and/or quality. For example, quantity and/or quality of the finisher draw sliver 5 produced by the draw frame textile machines 45 may be degraded, if quantity and/or quality of one or more of the raw cotton 1, the chute matt 2, and the carded sliver 3 does not match a desired quantity and/or quality.

Figure 2:
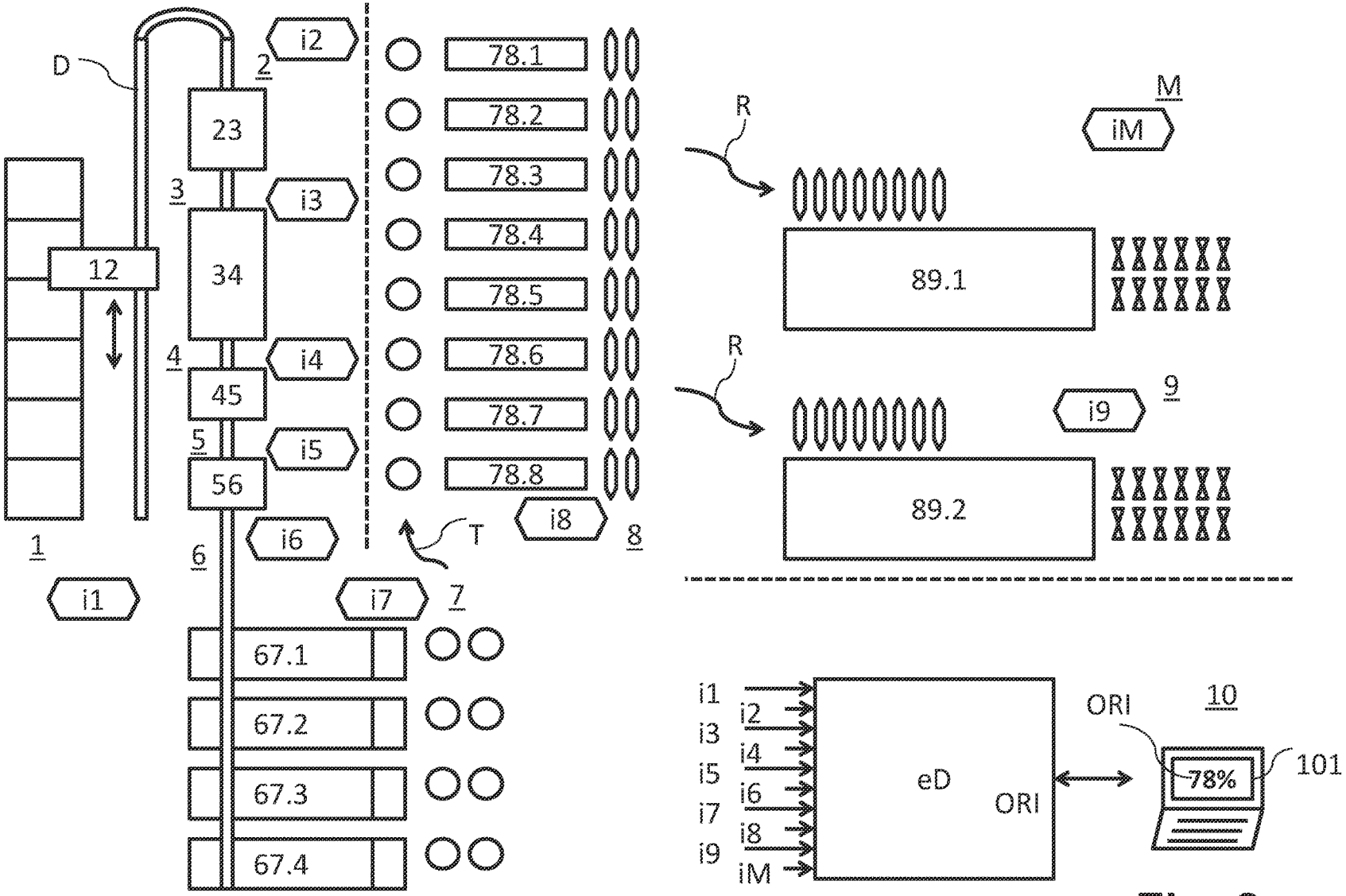
FIG. 2 illustrates schematically an exemplary configuration of a spinning mill, and an electronic device for enabling displaying on a user display an operational readiness index related to a spinning mill.

FIG. 2 illustrates schematically an exemplary configuration of a spinning mill M. Furthermore, FIG. 2 illustrates schematically an electronic device eD for enabling displaying on a user display 101 an operational readiness index ORI related to the spinning mill M. The spinning mill M illustrated in FIG. 2 includes different and/or additional textile machines than the textile machines illustrated in FIG. 1. The present disclosure is not limited to the exemplary configuration of a spinning mill M illustrated in FIG. 2, but also applies to any other configuration of a spinning mill having different numbers and/or types of textile machines, different numbers and/or types of auxiliary machines, different sequences of textile machines, etc.

The spinning mill M illustrated in FIG. 2 includes a bale opener 12 for processing raw material 1 into so-called microtufts 2. The bale opener 12 is followed by a pre-cleaner 23 for processing microtufts 2 into pre-cleaned textile material 3. The pre-cleaner 23 is followed by a homogenous mixer 34 for processing pre-cleaned textile material 3 into mixed textile material 4. The homogenous mixer 34 is followed by a storage and feeding machine 45 for finely cleaning the mixed textile material 4 into finely cleaned textile material 5. The storage and feeding machine 45 is followed by a condenser 56 for additionally cleaning the finely cleaned textile material 5 into additionally cleaned textile material 6. The condenser 56 is followed by four draw frame and sliver coiler textile machines 67.1, 67.2, 67.3, 67.4 for processing the additionally cleaned textile material 6 into card sliver coils 7. The four draw and sliver coiler units 67.1, 67.2, 67.3, 67.4 are followed by eight speed frame textile machines 78.1, 78.2, 78.3, 78.4, 78.5, 78.6, 78.7, 78.8 for processing the card sliver cols 7 into the roving 8. The eight speed frame machines 78.1, 78.2, 78.3, 78.4, 78.5, 78.6, 78.7, 78.8 are followed by two ring frame textile machines 89.1, 89.2 for processing the roving 8 into ring cops 9.

As illustrated in FIG. 2, auxiliary systems such as conveyor or transport systems are arranged. Further auxiliary systems may be arranged (not illustrated), such as compressed air systems, climate control systems, cooling systems for machine or facility parts, systems for power supply, etc. Conveyor or transport systems are arranged for transporting textile materials from a previous textile machine to a next textile machine. The transport systems may include duct systems D, trolley-type conveyor systems T, rail-type transport systems R, etc. A transport system may also include one or more automated guided vehicles (AGV). For example, in a duct system D textile material is transported by means of an air stream generated by a ventilator. For example, in a trolley-type conveyor system T textile material is transported by means of containers arranged on trolleys. For example, in a rail-type transport system R textile material is transported by means of transport devices arranged on rails. Other transport systems may be involved. In the example illustrated in FIG. 2, a duct system D is arranged for transporting textile material through the sequence of textile machines which include the bale opener 12, the pre-cleaner 23, the homogenous mixer 34, the storage and feeding machine 45, the condenser 56, and the draw frame and sliver coiler textile machines 67.1, 67.2, 67.3, 67.4. A trolley-type conveyor system T is arranged for transporting textile material from the draw and sliver coiler units 67.1, 67.2, 67.3, 67.4 to the speed frame textile machines 78.1, 78.2, 78.3, 78.4, 78.5, 78.6, 78.7, 78.8. A rail-type transport system R is arranged for transporting textile material from the speed frame textile machines 78.1, 78.2, 78.3, 78.4, 78.5, 78.6, 78.7, 78.8 to the ring frame textile machines 89.1, 89.2. Transport systems may be arranged in a different manner.

FIG. 2 illustrates an exemplary embodiment of a spinning mill M having particular numbers and types of textile machines, particular numbers and types of auxiliary machines, and a particular sequence of textile machines, i.e., textile machines which are followed by further textile machines for the further processing of textile material.

As illustrated in FIG. 2, operating information i1, i2, i3, i4, i5, i6, i7, i8, i9 is generated or sensed at the textile machines 12, 23, 34, 45, 56, 67, 78, 89 and at the spinning mill M, and the electronic device eD is configured for performing the step of collecting operating information i1, i2, i3, i4, i5, i6, i7, i8, i9, iM.

Operating information i1, i2, i3, i4, i5, i6, i7, i8, i9 generated or sensed at the textile machines 12, 23, 34, 45, 56, 67, 78, 89 may include rotation speed, energy consumption, temperature of at least some machine components, delivery, number of doffing, shift down time, time till doffing, can changes, relative pressure and quality (temperature, humidity, and/or impurities) of compressed air to be used.

Operating information i1, i2, i3, i4, i5, i6, i7, i8, i9 generated or sensed at the textile machines 12, 23, 34, 45, 56, 67, 78, 89 may include information about quantity and/or quality of textile materials 1, 2, 3, 4, 5, 6, 7, 8, 9 processed by the textile machines 12, 23, 34, 45, 56, 67, 78, 89, such as a weight per hour, a density, number of yarn breaks, number of sliver breaks, of fiber moisture, micronaire, fiber length, fiber length uniformity, fiber strength, fiber neps, fiber maturity, fiber color, fiber trash, yarn/sliver/roving count/hank, yarn/sliver/roving weight deviation, yarn/sliver/roving evenness, thick places, thin places, twist level, yarn strength, yarn elongation properties, tenacity, twist and count, yarn hairiness, yarn abrasion resistance wear properties, yarn color, etc. of textile material processed by the textile machines 12, 23, 34, 45, 56, 67, 78, 89.

Operating information iM generated or sensed at the spinning mill M may include environmental information of the spinning mill M, such as an atmospheric temperature, an atmospheric humidity, atmospheric pressure, air pollution, precipitation, solar irradiation, etc. It is also possible to use environmental information at least partly based on empirical values (e.g. historical and statistical climate values for the location of a spinning mill). It is also possible to use environmental information at least partially based on short- and/or medium- and/or long-term forecasts of atmospheric temperature, atmospheric humidity, air pollution, precipitation solar radiation, etc.

Operating information iM generated or sensed at the spinning mill M may include safety-relevant information, such as the presence of fire extinguishing equipment and/or the condition of corresponding equipment (e.g. filling levels of extinguishing gas and/or extinguishing water containers) or that presence and/or status of a fire detection and diverter system.

Operating information iM generated or sensed at the spinning mill M may include the number/frequency and/or type of notifications that at least one machine of a spinning mill issues to an operator person. Such notifications may e.g. include error messages, requests for intervention by the operator (e.g. can change, traveler change, cleaning/unclogging etc.). Operating information iM generated or sensed at the spinning mill M may include whether and/or how quickly and/or how reliably an operator person responded to notifications.

For sensing operating information i1, i2, i3, i4, i5, i6, i7, i8, i9, respective electronic sensors may be arranged. Electronic sensor may relate to electronic sensors for sensing a rotation speed, electronic sensors for sensing power consumption, etc. Furthermore, operating information i1, i2, i3, i4, i5, i6, i7, i8, i9 may include laboratory-analyzed findings, such as fiber densities, lubricant quality, etc.

Operating information i1, i2, i3, i4, i5, i6, i7, i8, i9, iM may be sensed and/or collected regularly or irregularly in time. Operating information i1, i2, i3, i4, i5, i6, i7, i8, i9, iM may be captured within short intervals at high speed or within long intervals at low speed. For example, operating information i1, i2, i3, i4, i5, i6, i7, i8, i9 sensed with electronic sensors may be captured regularly at high speed such as every minute, every second, etc. For example, operating information i1, i2, i3, i4, i5, i6, i7, i8, i9 requiring laboratory-analyzed findings may be captured irregularly at low speed, such as every Monday and Thursday, after machine maintenance, etc.

As illustrated in FIG. 2, the operating information i1, i2, i3, i4, i5, i6, i7, i8, i9, iM is sensed at specific locations. Accordingly, specific operating information, such as operating information with reference sign i3, may relate to a specific location in the spinning mill M, for example for sensing a specific rotation speed of a rotor of a textile machine, a specific power consumption of a specific textile machine, a specific diameter of a textile material produced by a specific textile machine, etc.

FIG. 2 schematically illustrates an electronic device eD for enabling displaying on a user display 101 the operational readiness index ORI in accordance to this disclosure.

The electronic device eD may take the form of a computer, for example a computer that is generally used in one place (such as a conventional desktop computer, workstation, server, etc.) or a computer that is generally portable (such as a laptop, notebook, tablet, handheld computer, etc.). The electronic device eD may include a machine-readable medium having stored thereon instructions which program a processor of the electronic device eD to perform some or all of the operations and functions described in this disclosure. A machine-readable medium may include any mechanism for storing or transmitting information in a form readable by a machine (e.g., a computer), such as Hard Disk drives (HD), Solid State Disk drives (SSD), Compact Disc Read-Only Memory (CD-ROMs), Read-Only Memory (ROMs), Random Access Memory (RAM), Erasable Programmable Read-Only Memory (EPROM), etc. In other embodiments, some of these operations and functions might be performed by specific hardware components that contain hardwired logic. Those operations and functions might alternatively be performed by any combination of programmable computer components and fixed hardware circuit components. In some embodiments, the machine-readable medium includes instructions stored thereon, which when executed by a processor, causes the processor to perform the method on an electronic device eD as described in this disclosure.

As illustrated in FIG. 2, the electronic device eD is configured to collect operating information i1, i2, i3, i4, i5, i6, i7, i8, i9, iM of the textile machines 12, 23, 34, 45, 56, 67, 78, 89 and/or of the textile materials 1, 2, 3, 4, 5, 6, 7, 8, 9 and/or of the spinning mill M. For example, electronic sensors configured to sense respective operating information i1, i2, i3, i4, i5, i6, i7, i8, i9, iM are arranged at respective locations in the spinning mill M and electronic signals representing the sensed operating information i1, i2, i3, i4, i5, i6, i7, i8, i9, iM are transmitted from the electronic sensor via a computer network to the electronic device eD. The transmission may be wired, wireless or other means of electronic transmission like mobile network, Bluetooth, ZigBee, etc. Furthermore, operating information i1, i2, i3, i4, i5, i6, i7, i8, i9, iM sensed in accordance with laboratory-analyzed findings may be transmitted via a computer network to the electronic device eD. Accordingly, the electronic device eD is configured to collect operating information i1, i2, i3, i4, i5, i6, i7, i8, i9, iM about any desired component of the spinning mill M. The electronic device eD may be located in the spinning mill (on Edge), or at a remote location or in an internet (Cloud, e.g. www), or distributed between Edge and Cloud.

The electronic device eD is configured to determine from the operating information i1, i2, i3, i4, i5, i6, i7, i8, i9, iM the operational readiness index ORI.

For example, for determining the operational readiness index ORI, a scalar value is determined by summing up a rotation speed or a produced quantity of textile material of textile machines 12, 23, 34, 45, 56, 67, 78, 89 weighted with a respective time span since last service of the respective textile machine 12, 23, 34, 45, 56, 67, 78, 89.

According to another example, for determining the operational readiness index ORI, a scalar value is determined by calculating the percentage of responses to system notifications of one or more operator persons within one or more predefined maximum response times after the system notifications have been made by the system. For example, system notifications may relate to messages instructing operator persons to perform maintenance work, such as in case of a broken element of the spinning mill.

As illustrated in FIG. 2, the electronic device eD is configured to access the operational readiness index ORI for enabling displaying on a user display 101 the operational readiness index ORI. As illustrated in FIG. 2, the operational readiness index ORI may be displayed on a user display 101 which is external from the electronic device E, such as a smartphone of a user.

In the prior art, various indices and measures are known. A key-performance-index evaluates the success of an organization or of a particular activity (such as projects, programs, products and other initiatives) in which it engages. Overall equipment effectiveness (OEE) is a measure of how well a manufacturing operation is utilized (facilities, time and material) compared to its full potential, during the periods when it is scheduled to run. It identifies the percentage of manufacturing time that is truly productive. An OEE of 100% means that only good parts are produced (100% quality), at the maximum speed (100% performance), and without interruption (100% availability).

Contrary to the indices and measures of the prior art, the operational readiness index is directed to an evaluation of a readiness of a spinning mill M for executing already planned as well as possible and probable future tasks. The operational readiness index may be determined or normalized with respect to a target value or nominal value of a spinning mill. The target value or nominal value may depend on the age, size, configuration, etc. of the spinning mill. Thus, a normalized operational readiness index of 100% may indicate that the spinning mill is ready for executing already planned as well as possible and probable future tasks, while an operational readiness index of 80% may indicate that the spinning mill is not ready for executing some of the already planned as well as possible and probable future tasks, because, for example, a particular combination of states of textile machines may prevent execution of some of the already planned or possible and probable future tasks, even if each textile machine may have a normal state. On the basis of the operational readiness index, the operator persons (responsible persons) of the spinning mill may decide if the state of the spinning mill is still acceptable, or if a detailed analysis has to be performed for identifying the cause of a reduced operational readiness of the spinning mill M.

Figure 3A:
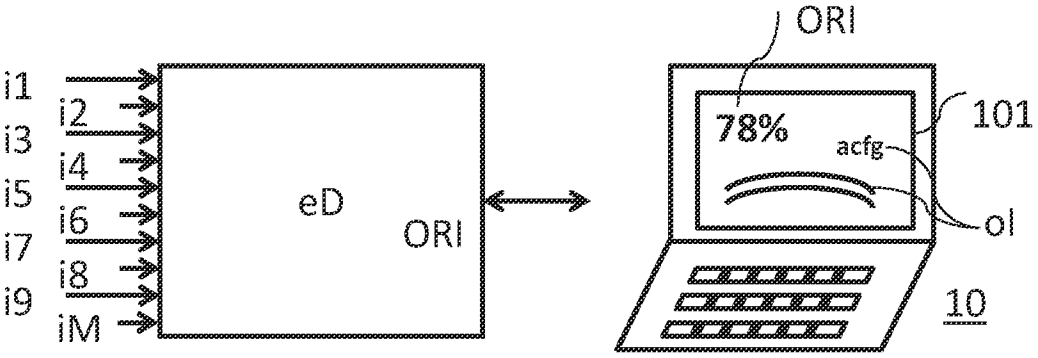
FIG. 3*a*, 3*b* illustrate schematically exemplary embodiments of an electronic device for enabling displaying on a user display an operational readiness index related to a spinning.

FIG. 3*a* illustrates an electronic device eD having the form of a computer server which communicates with a user device 10 for displaying an operational readiness index ORI of the spinning mill M on the user device 10. The computer server may relate to server running an operating system such as Windows®, Windows Server®, UNIX, etc. being configured for executing the functions described herein. The computer server is configured for collecting operating information i1, i2, i3, i4, i5, i6, i7, i8, i9, iM about the spinning mill M, and for determining from the operating information i1, i2, . . . , i9, iM the operational readiness index ORI. The computer server is configured for transmitting the operational readiness index ORI to the user device 10. The user device 10 includes a display 101 for displaying operating information of the spinning mill, such as current and past throughput, state information of textile machines, etc. The user device 10 is further configured for displaying the operational readiness index ORI on the display 101. The user device 10 may be a personal computer, a laptop computer, a smartphone, a wearable device like a smartwatch, a watch with an display, a bracelet with a display, a tag with a display or an item of clothing with a display etc.

Figure 3B:
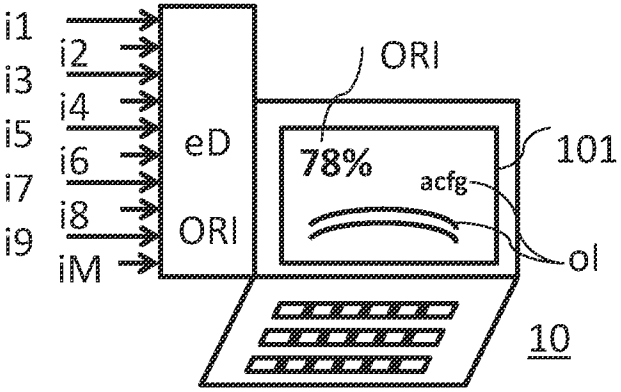

FIG. 3*b* illustrates an electronic device eD having the form of a functional module attached to a user device 10, for example the functional module has the form of a software module being executed on the user device 10 for collecting operating information i1, i2, i3, i4, i5, i6, i7, i8, i9, iM about the spinning mill M, and for determining from the operating information i1, i2, . . . , i9, iM the operational readiness index ORI. The user device 10 may include the same features as the user device 10 illustrated in FIG. 3*a*.

Figure 4:
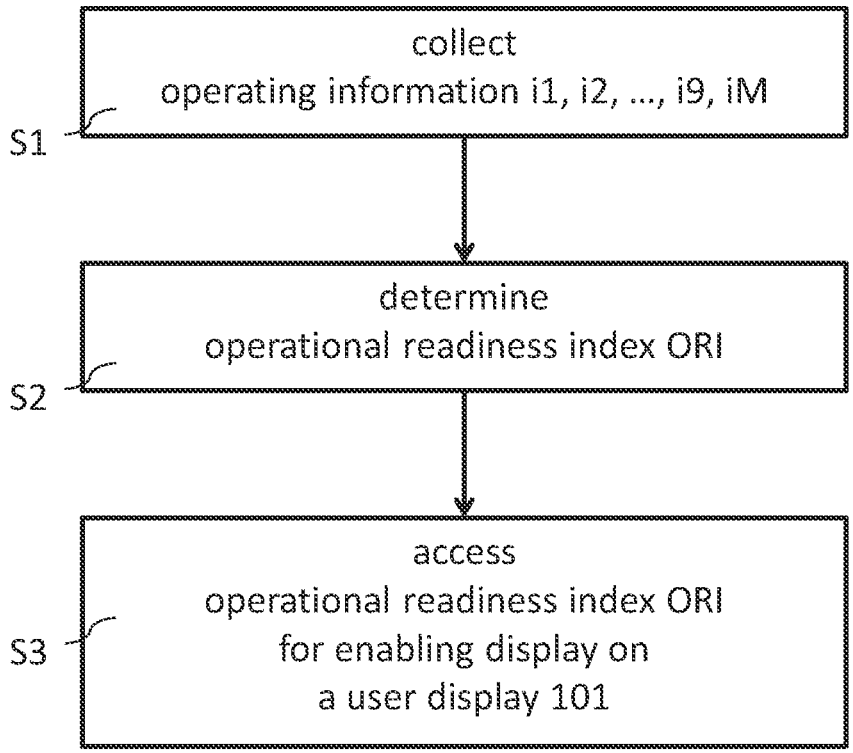
FIG. 4 illustrates schematically possible method steps of a method for enabling displaying on a user display an operational readiness index related to a spinning mill.

FIG. 4 illustrates schematically possible method steps of a method for enabling displaying on a user display 101 an operational readiness index ORI related to a spinning mill M. In step S1, an electronic device eD receives operating information i1, i2, i3, i4, i5, i6, i7, i8, i9, iM of one or more textile machines 12, 23, 34, 45, 56, 67, 78, 89 and/or of one or more textile materials 1, 2, 3, 4, 5, 6, 7, 8, 9 and/or of the spinning mill M. In step S2, the electronic device eD determines from the operating information i1, i2, . . . , i9, iM the operational readiness index ORI. In step S3, the electronic device E accesses the operational readiness index ORI for enabling displaying on a user display 101 the operational readiness index ORI. For example, the operational readiness index ORI may be transmitted to the user display 101 via a push-interface, such as SMS (SMS: Short Message Service), or via a pull-interface, such as a Web-Server running on the electronic device eD.

REFERENCE NUMERALS/SIGNS

M spinning mill
1,2,3,4,5,6,7,8,9 textile materials
12,23,34,45,56,67,78,89 textile machines
i1,i2,i3,i4,i5,i6,i7,i8,i9 operating information of the textile machines and/or the textile materials
iM operating information of the spinning mill
D duct system
T trolley-type conveyor system
R rail-type transport system
eD electronic device for detecting that a spinning mill has a fault and for estimating a source of the fault
10 user device
101 user display
ORI operational readiness index

The invention claimed is:

1. An electronic device (eD) configurable with a spinning mill, comprising:
a user display that displays an operational readiness index (ORI) related to the spinning mill;
the electronic device (eD) configured to:
collecting operating information of the spinning mill;
from the operating information, determine the operational readiness index (ORI);
access the operational readiness index; and
display the operational readiness index (ORI) on the user display.

2. The electronic device (eD) according to claim 1, wherein the operating information includes machine information of one or more textile machines of the spinning mill.

3. The electronic device (eD) according to claim 2, wherein the operating information includes machine information of one or more auxiliary machines of the spinning mill.

4. The electronic device (eD) according to claim 2, wherein the operating information includes one or both of: a quantity and a quality of one or more textile materials input to the textile machines; and a quantity and a quality of one or more textile materials output from the textile machines.

5. The electronic device (eD) according to claim 1, wherein the operating information includes one or more type of environmental information of the spinning mill.

6. The electronic device (eD) according to claim 1, further configured to collect the operating information via a computer network or a user interface.

7. The electronic device (eD) according to claim 1, further configured to determine the operational readiness index (ORI) in a form of a single scalar value.

8. The electronic device (eD) according to claim 1, further configured to determine the operational readiness index (ORI) in a form of a vector of values.

9. The electronic device (eD) according to claim 1, further configured to determine the operational readiness index (ORI) as a percentage.

10. The electronic device (eD) according to claim 1, further configured to transmit the operational readiness index (ORI) via a push interface or a pull interface.

11. The electronic device (eD) according to claim 1, further configured to determine information relating to physical configuration of textile machines in the spinning mill used to improve the operational readiness index (ORI) and for enabling display of the physical configuration information on the user display.

12. The electronic device (eD) according to claim 1, further configured to determine actions to improve the operational readiness index (ORI) and to display the actions on the user display.

13. A method executed via an electronic device (eD) for enabling display on a user display of an operational readiness index (ORI) related to a spinning mill, comprising:
collecting operating information of the spinning mill;
from the operating information, determining the operational readiness index (ORI); and
accessing and displaying the operational readiness index (ORI) on the user display.

14. The method according to claim 13, wherein the operating information includes machine information of one or more textile machines of the spinning mill.

15. The method according to claim 14, wherein the operating information includes machine information of one or more auxiliary machines of the spinning mill.

16. The method according to claim 14, wherein the operating information includes one or both of: a quantity and a quality of one or more textile materials input to the textile machines; and a quantity and a quality of one or more textile materials output from the textile machines.

17. The method according to claim 13, wherein the operating information includes one or more type of environmental information of the spinning mill.

18. The method according to claim 13, wherein the operating information is collected via a computer network or a user interface.

19. The method according to claim 13, further comprising determining the operational readiness index (ORI) in a form of a single scalar value.

20. The method according to claim 13, further comprising determining the operational readiness index (ORI) in a form of a vector of values.

21. The method according to claim 13, further comprising determining the operational readiness index (ORI) as a percentage.

22. The method according to claim 13, further comprising transmitting the operational readiness index (ORI) via a push interface or a pull interface.

23. The method according to claim 13, further comprising determining information relating to physical configuration of textile machines in the spinning mill used to improve the operational readiness index (ORI) and displaying the physical configuration information on the user display.

24. The method according to claim 13, further comprising determining actions to improve the operational readiness index (ORI) and displaying the actions on the user display.

* * * * *